US006490953B2

(12) United States Patent
Horvath

(10) Patent No.: US 6,490,953 B2
(45) Date of Patent: Dec. 10, 2002

(54) EXTERNALLY CAPTURED RATCHET HEAD AND HOUSING ASSEMBLY

(75) Inventor: John Horvath, Cuyahoga Falls, OH (US)

(73) Assignee: Mechanics Custom Tools Corp., Wilmington, DE (US)

( * ) Notice: Subject to any disclaimer, the term of this patent is extended or adjusted under 35 U.S.C. 154(b) by 0 days.

(21) Appl. No.: 09/833,775

(22) Filed: Apr. 12, 2001

(65) Prior Publication Data

US 2002/0148331 A1 Oct. 17, 2002

(51) Int. Cl.[7] ..... B25B 13/46
(52) U.S. Cl. ..... 81/57.39; 81/63.2
(58) Field of Search ..... 81/57.39, 60–63.2

(56) References Cited

U.S. PATENT DOCUMENTS

| | | | | |
|---|---|---|---|---|
| 2,764,048 A | | 9/1956 | Thompson | |
| 3,529,498 A | | 9/1970 | Northcutt | |
| 4,903,554 A | | 2/1990 | Colvin | |
| 5,086,673 A | | 2/1992 | Korty | |
| 5,140,874 A | * | 8/1992 | Junkers | 81/57.39 |
| 5,142,952 A | | 9/1992 | Putney et al. | |
| 5,178,047 A | | 1/1993 | Arnold et al. | |
| 5,199,330 A | * | 4/1993 | Arnold et al. | 81/63.2 |
| 5,231,901 A | | 8/1993 | Putney et al. | |
| 5,237,885 A | | 8/1993 | Putney et al. | |
| 5,309,714 A | | 5/1994 | Putney et al. | |
| 5,425,291 A | | 6/1995 | Chang | |
| 5,450,773 A | | 9/1995 | Darrah et al. | |
| 5,537,899 A | | 7/1996 | Diedrich | |
| 5,630,343 A | | 5/1997 | Begin | |
| 5,697,267 A | | 12/1997 | Tsai | |
| 5,896,789 A | | 4/1999 | Giardino | |
| 6,067,881 A | | 5/2000 | Albertson | |

OTHER PUBLICATIONS

Four (4) Photograph of a Prior Art Snap–On Air Ratchet Undated.
One (1)Copy of the Owner's Manual of the Snap–On Air Ratchet, (Undated).

* cited by examiner

*Primary Examiner*—James G. Smith
(74) *Attorney, Agent, or Firm*—Hahn Loeser + Parks LLP; Alexander D Bommarito, Esq

(57) ABSTRACT

The present invention provides novel ratchet head configurations for externally capturing a ratchet mechanism within the head of a powered ratchet wrench, such as a pneumatic ratchet wrench for example. Externally capturing the ratchet mechanism prevents the separation of the ears of the ratchet mechanism, caused by the application of torque to the ratchet head design. In prior art designs, repeated application of torque to the ratchet head caused separation of the ratchet head ears, and in turn, malfunctioning of the ratchet caused by loss of tension between the yoke of the ratchet and ratchet head itself. By preventing the ears from separating, the present invention maintains proper operation, and increased tool life. Furthermore, the tools maintenance and repair costs are decreased.

40 Claims, 12 Drawing Sheets

EXTERNALLY CAPTURED RATCHET HEAD AND HOUSING ASSEMBLY

FIELD OF THE INVENTION

The present invention is generally a novel powered ratchet head design. More specifically, the present invention is a ratchet head design having external features for retaining the ratchet mechanism within the head.

BACKGROUND OF THE INVENTION

Various powered ratchet wrench designs have been designed, manufactured and marketed. As shown in FIG. 1, the prior art design is shown at 10 having a head portion 12 and a handle portion 14. Within head portion 12 is a ratchet mechanism 16, which is enclosed within a yoke 18. Handle portion 14 includes a housing 20 which encloses a drive motor, not shown. Generally, such drive motors have been pneumatic, but other motors have been utilized. The end of handle portion 14 contains a compressed air inlet port 22, which connects to a compressed air supply by various means known in the art. An actuation button or lever 24 is located between air inlet port 22 and housing 20, which allows the operator to actuate the pneumatic motor, the drive mechanism (not shown) and ratchet mechanism 16.

As shown in FIG. 2, the prior art ratchet mechanism 16 contains a shift lever 25, a pawl 28 and a ratchet body 30 having a drive square 26. Alternatively, ratchet mechanism 16 may contain more than one pawl 28. Ratchet mechanism 16 fits within yoke 18 in order to allow for rotation of drive square 26 caused by interaction of pawl 28 and the teeth formed on yoke 18.

When assembled, ratchet mechanism 16 is retained within ratchet head 12 on one end by ear 11 of ratchet housing 12, which is in contact with the upper end of ratchet body 30, opposite drive square 26, and on the other end by an internal snap ring 32, which fits within a groove 34 formed within ear 13, of ratchet head 12. Between snap ring 32 and the lower end of ratchet body 30 is provided a tensioning means, such as a compressed belleville spring washer 31, for example. The belleville spring washer or belleville washer 31, is held in a compressed state between the lower end of ratchet body 30 and snap ring 32. Compressed belleville washer 31 biases ratchet body 30 toward ear 11 of head portion 12 and provides friction for ratchet mechanism 16. This friction is commonly referred to in the art as head tension or simply tension, and allows for advancement of ratchet mechanism 16 within yoke 18, as yoke 18 moves with reciprocating motion within ratchet head 12.

Because the ratchet mechanism 16 is retained internally within ratchet housing 12 between ears 11 and 13, when torque is applied to the ratchet head, the ears 11, 13 of ratchet head 12 begin to widen apart or spread. Upon repeated application of torque to ratchet head 12, ears 11 and 13 may remain in a spread position. This causes ratchet mechanism 16 to function improperly and slip upon application of force to drive square 26 because ears 11 and 13 no longer hold the tensioning means in a compressed state, and the resulting loss of tension between the tensioning means, for example a belleville spring washer, and the ears 11 and 13 does not allow ratchet mechanism 16 to advance within yoke 18. This is a significant problem in prior art ratchet head designs and increases the costs to maintain these ratchet wrenches for both the end user/owner and the ratchet wrench manufacturers.

Therefore, there is a need for an improved ratchet head design which prevents spreading of the ratchet head ears and thus, maintains proper operation of the ratchet mechanism of the pneumatic ratchet wrench.

SUMMARY OF THE INVENTION

It is a general object of the present invention to provide a powered ratchet wrench design which prevents spreading of the ratchet head, and thus proper operation of the ratchet wrench.

It is another object of the present invention to provide a powered ratchet wrench design which contains components which are easily replaceable upon excess wear.

It is yet another object of the present invention to provide a powered ratchet wrench that has decreased maintenance costs.

These and other objects of the present invention are accomplished by providing a ratchet head design which externally captures the ratchet mechanism between the ears of the ratchet head. Capturing the ratchet mechanism externally prevents the ears from spreading. The present invention also provides easily and rather inexpensively replaceable wear washers positioned adjacent the wear surfaces of the ratchet head. Through the prevention of spreading of the ratchet head and having replaceable wear surfaces, the life of the tool is increased.

DETAILED DESCRIPTION OF THE PREFERRED EMBODIMENT

Reference will now be made in detail to the present preferred embodiments of the present invention, examples of which are illustrated in the accompanying drawings. Whenever possible, the same reference numbers will be used throughout the drawings to refer to the same or like parts.

Figure 1:
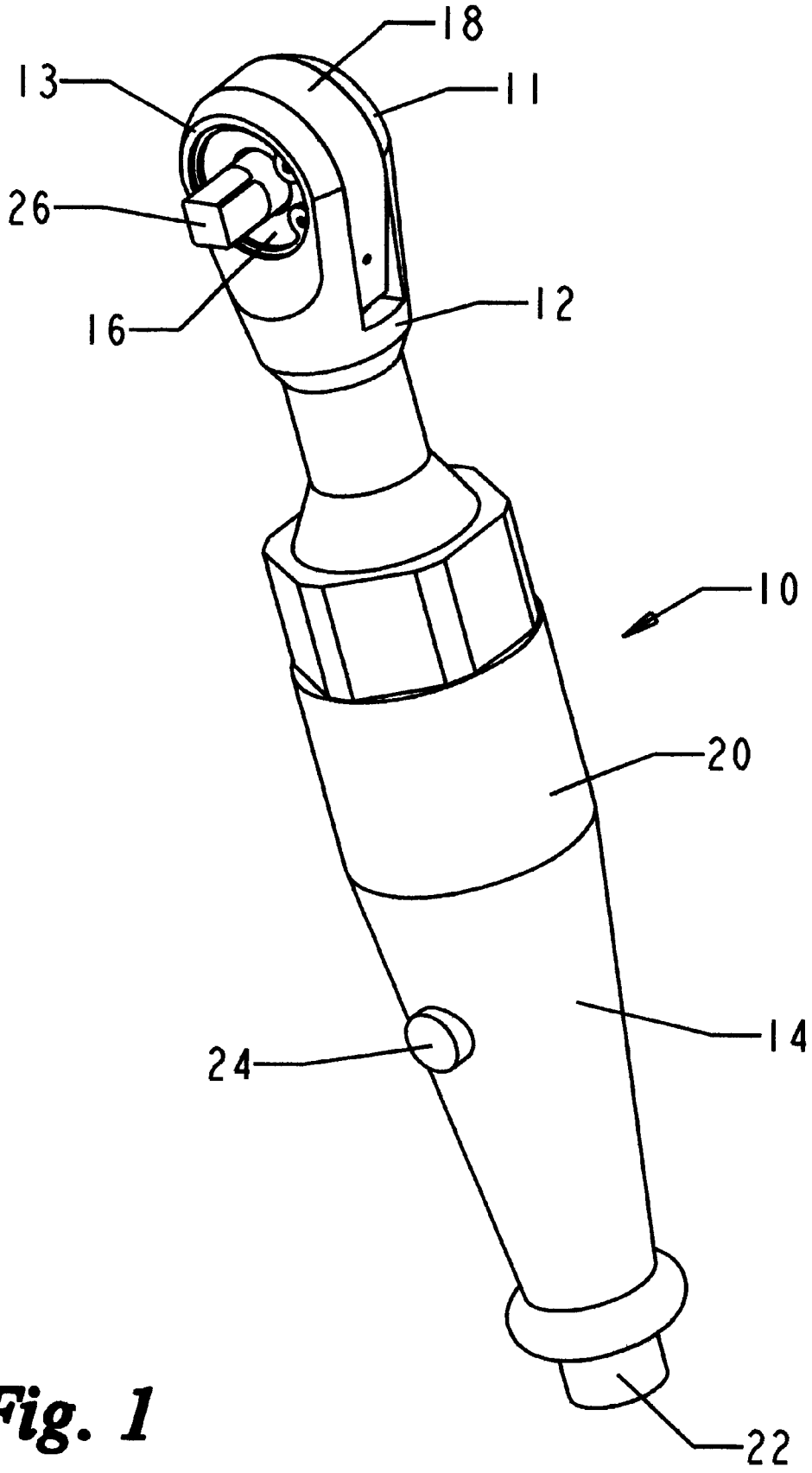
FIG. 1 is a perspective view of a prior art ratchet head design.
Figure 2:
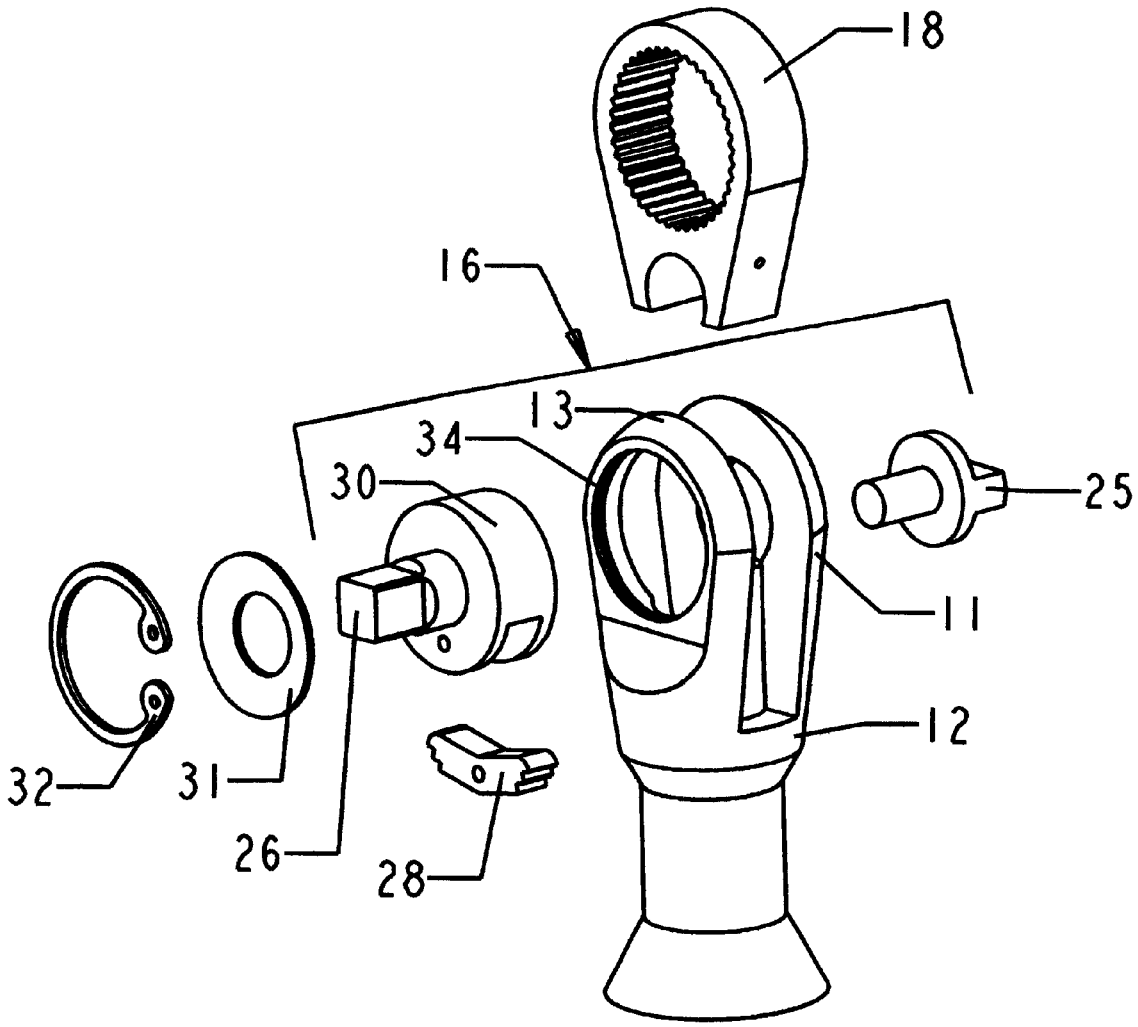
FIG. 2 is an exploded perspective view of a prior art ratchet head design.
Figure 3:
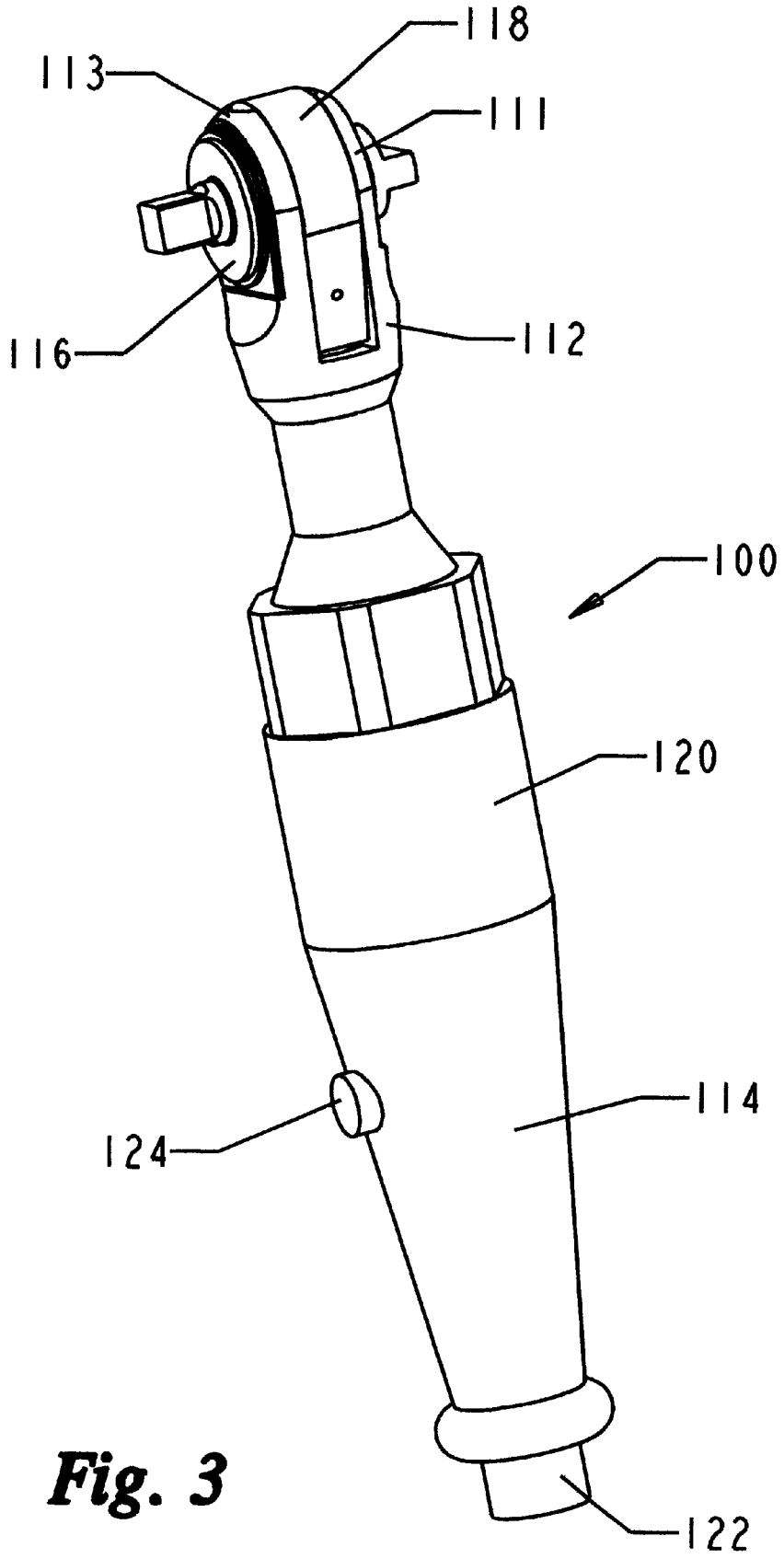
FIG. 3 is perspective view of a first preferred embodiment of the present invention.

As shown in FIG. 3, there is shown a first preferred embodiment of the present invention, shown generally at 100 having a head portion 112 and a handle portion 114. Head portion 112 has two ears 111 and 113 between which is inserted yoke 118. Bores are formed within ears 111 and 113 to allow for placement of a ratchet mechanism 116 as described herein. Yoke 118 also has a bore formed therein having teeth formed about the circumference of the bore which engage teeth formed on a pawl 160 of ratchet mechanism 116. Handle portion 114 includes a housing 120 which encloses a drive motor, not shown. Although a pneumatic drive motor is described as the preferred power source, and is well known in the art, other motors such as electric motors, can be used to drive ratchet wrench designs of the present invention. The end of handle portion 114 has an air inlet port 122 for connection to a compressed air supply by various means known in the art. An actuation button is located between housing 120 and air inlet port 122, which allows the operator to actuate the pneumatic motor, the drive mechanism, and the ratchet mechanism 116. This actuator may be a button as shown, a lever, or any other type of throttle valve activating device known and used in the art.

Figure 4:
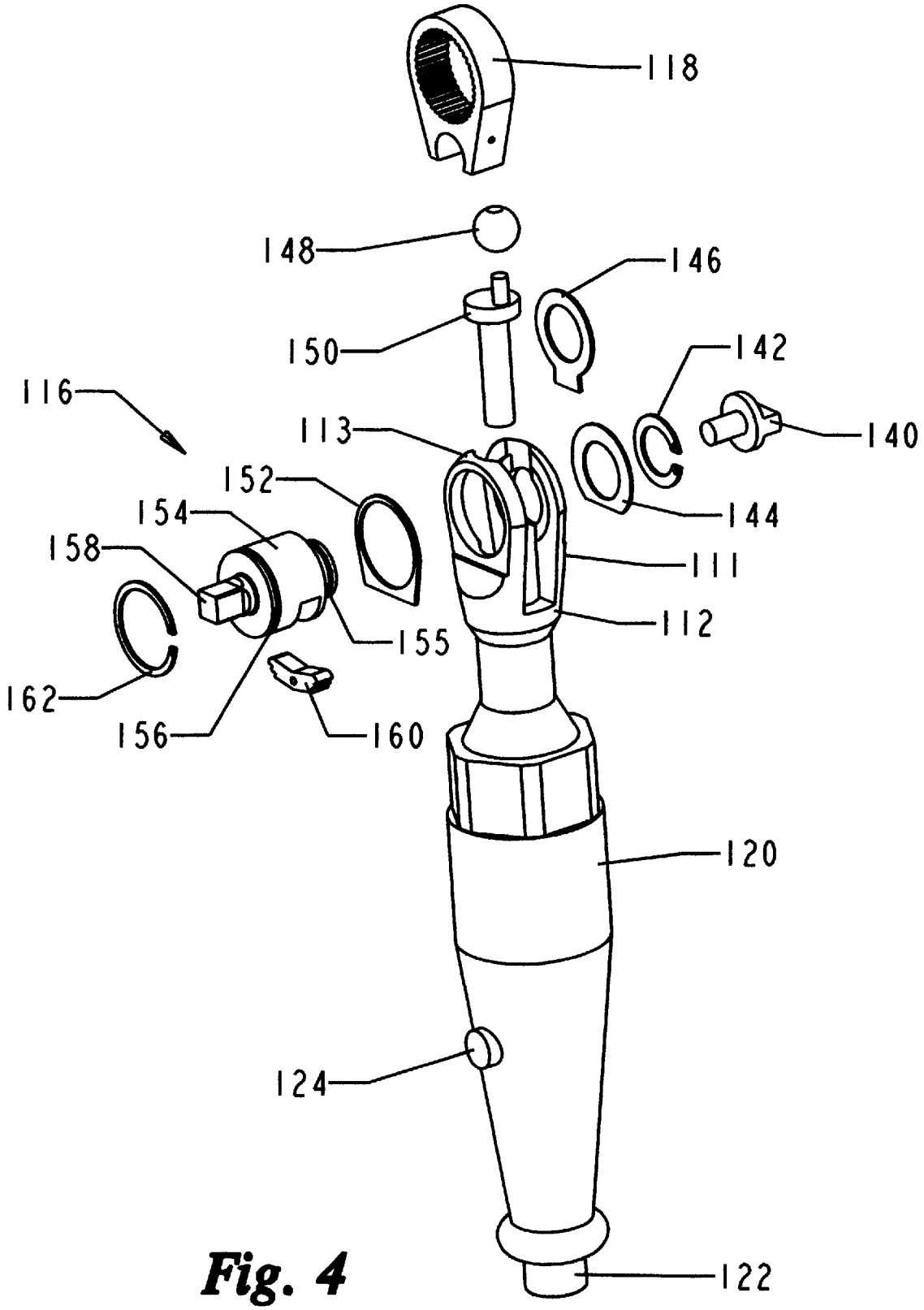
FIG. 4 is an exploded perspective view of a first preferred embodiment of the present invention.

Referring to FIG. 4 there is shown a disassembled view of the first preferred embodiment of the present invention. The drive mechanism is comprised of a crank 150 and a drive bushing 148 which fits within head portion 112, when assembled. Drive bushing 148 fits within a recess formed in yoke 118. Crank 150 is rotated by a pneumatic motor (not shown), which in turn causes drive bushing 148 to revolve and yoke 118 to reciprocate.

The ratchet mechanism, shown generally as 116 in FIG. 3, is comprised of a ratchet body 154, one or more pawls 160, a drive square 158, and a shift lever 140. Ratchet body 154 has a first groove 155 at the upper end of ratchet body 154, and a second groove 156 formed at the lower end of ratchet body 154. Shift lever 140 allows for selection of the direction of rotation of drive square 158 and any socket affixed to drive square 158. Ratchet mechanism 116 fits within yoke 118 to allow for rotation of drive square 158.

Also provided with the present design are replaceable wear washers 144, 146 and 152. Wear washers 144, 146 and 152 are provided along the primary wear surfaces of the ratchet wrench head of the present invention, and thus prevent head portion 112 from becoming worn. Thus, wear washer 144 is placed on the outer surface of ear 111, wear washer 146 is placed on the inner surface of ear 111 and wear washer 152 is placed on the outer surface of ear 113. Wear washers 144, 146 and 152 are replaced as necessary to prevent damage to head portion 112.

Figure 5:
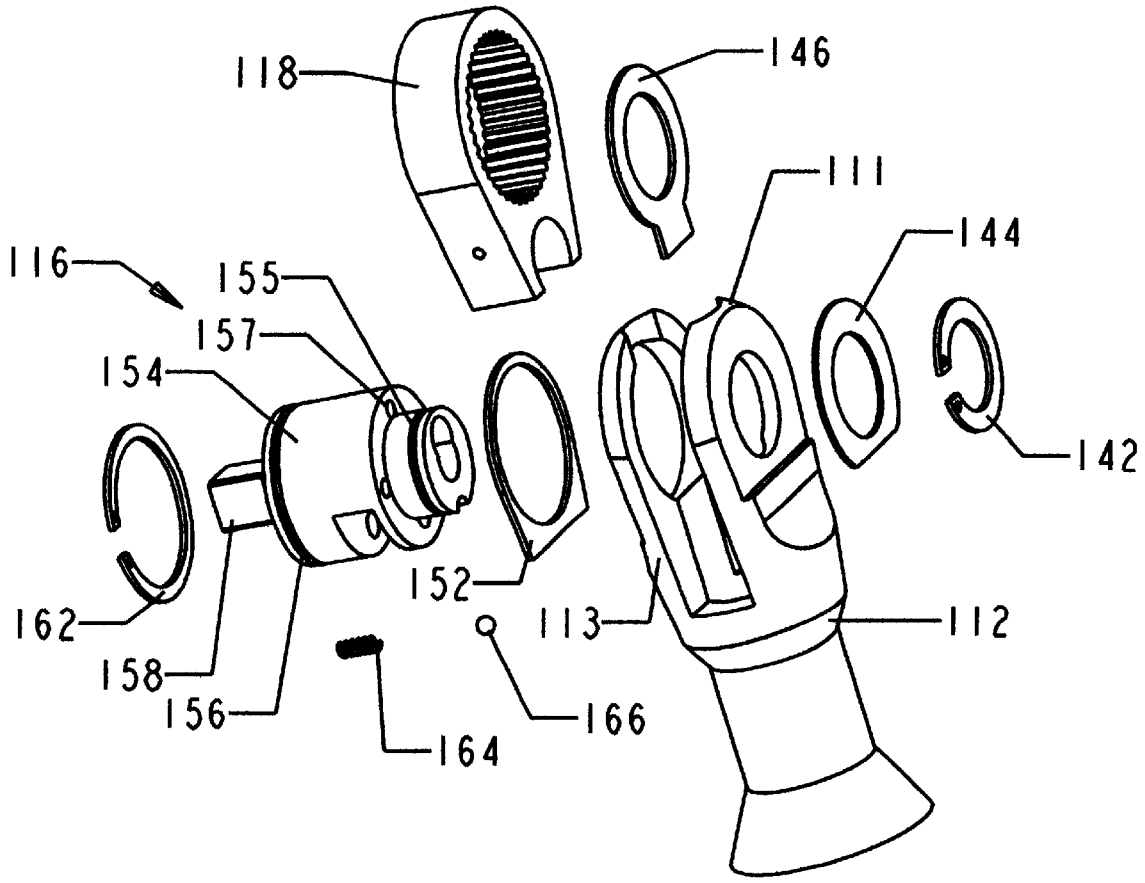
FIG. 5 is an exploded perspective view of a first preferred embodiment of the present invention.
Figure 6:
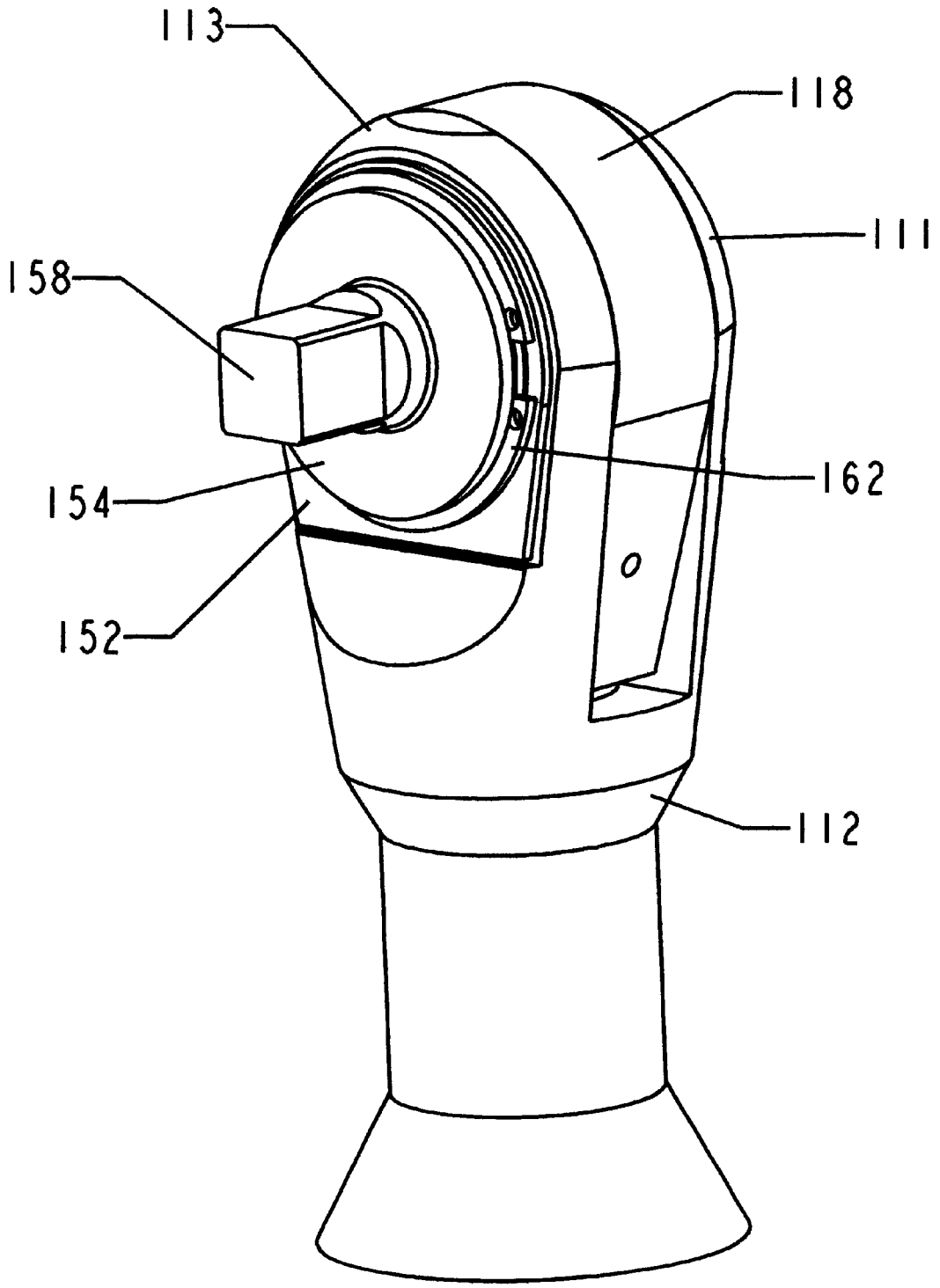
FIG. 6 is a perspective view of an assembled first preferred embodiment of the present invention.

As shown in FIG. 5, the ratchet wrench of the present invention includes a tensioning mechanism that creates the required friction within head mechanism 116. This friction is commonly referred to in the art as head tension or simply tension. In this embodiment, and example of such a tensioning mechanism is shown as a compressed spring 164 and ball 166, which are used to provide sufficient tension to ratchet 116, caused by spring 164 biasing ball 166 into wear washer 146. This creates the required head tension for ratchet mechanism 116, containing pawl 128, to advance the ratchet within yoke 118, as yoke 118 moves with reciprocating motion. At least two spring 164 and ball 166 combinations are used to provide sufficient tension to ratchet 116. The combination of spring 164 and ball 164 are held in position upon ratchet body 154 within depressions 157. Other tensioning mechanisms may be used, such as a belleville washer, a compression spring, a compression spring and a cylindrical plunger or other friction surface, as well as any other tensioning means known and used in the art.

Ratchet mechanism 116 and yoke 118 are retained within head portion 112 by means of mechanical fasteners, such as snap rings 142 and 162. Yoke 118 is placed between ears 111 and 113 of head portion 112. Wear washers 144, 146 and 152 are positioned about ratchet body 154. Snap rings 142 and 162 are then affixed within grooves 155 and 156, respectively, completing assembly of the ratchet head. Because snap rings 142 and 162 are positioned externally, ears 111 and 113 are prevented from spreading upon the application of torque to head portion 112. This prevents malfunctioning of ratchet mechanism 116, caused by the decrease in head tension, thus causing ratchet mechanism 116 not to advance within yoke 118 and a loss of the ratcheting action between the teeth formed on pawl(s) 160 and the teeth formed on the inner surface of yoke 118.

As this ratchet head design externally retains the ratchet mechanism by snap rings 142 and 162 which are in rotational contact with wear washers 114 and 152 respectively, wear washers 144 and 152 may be utilized to prevent wear to ratchet head portion 112. Since wear washers 144 and 152 are replaceable, damage to head portion 112 is decreased and the life of the tool is increased. Wear washer 146 is in contact with balls 166 of the rotating tensioning means, and therefore also helps to decrease wear to head portion 112.

Figure 7:
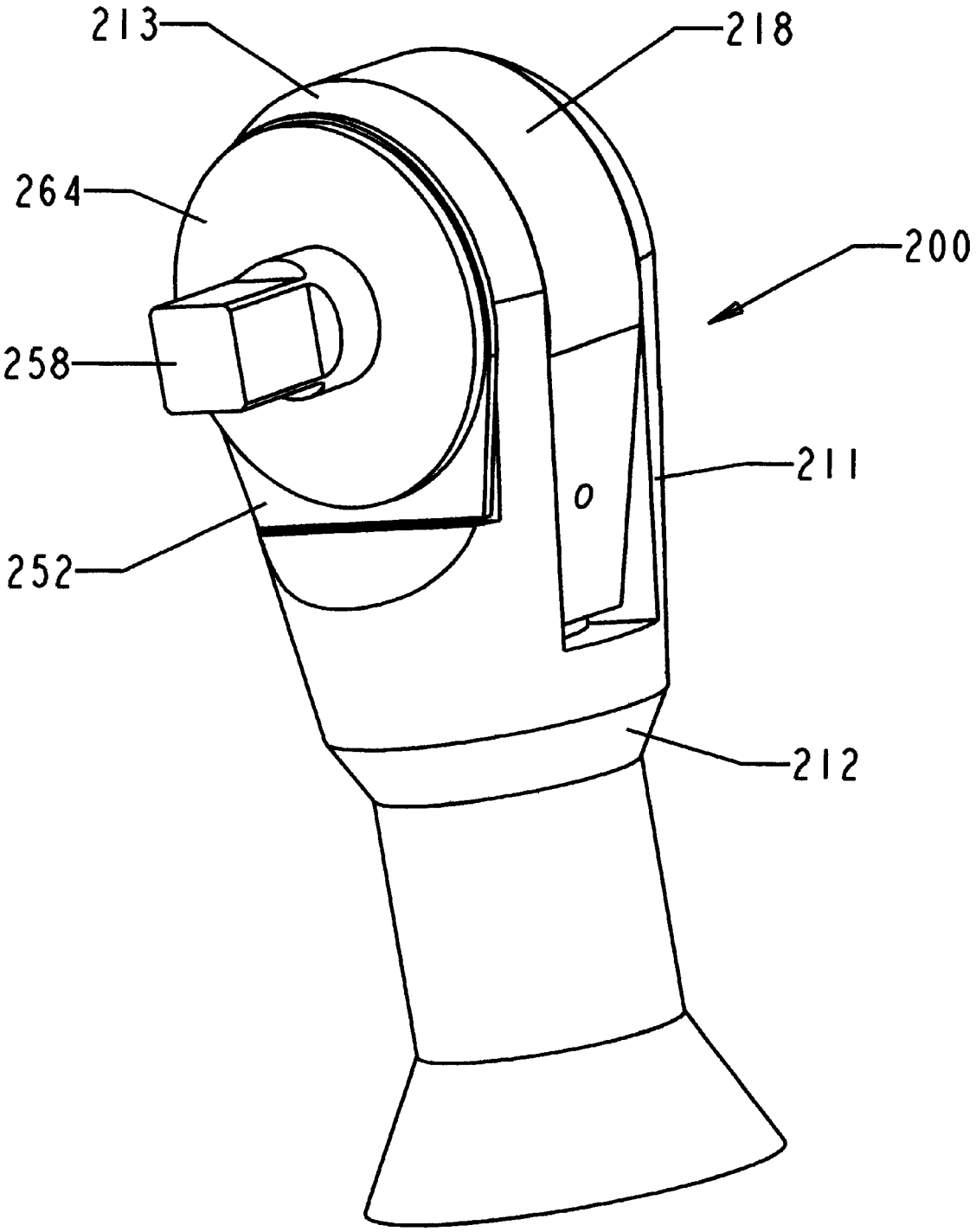
FIG. 7 is a front perspective view of an assembled second preferred embodiment of the present invention.
Figure 8:
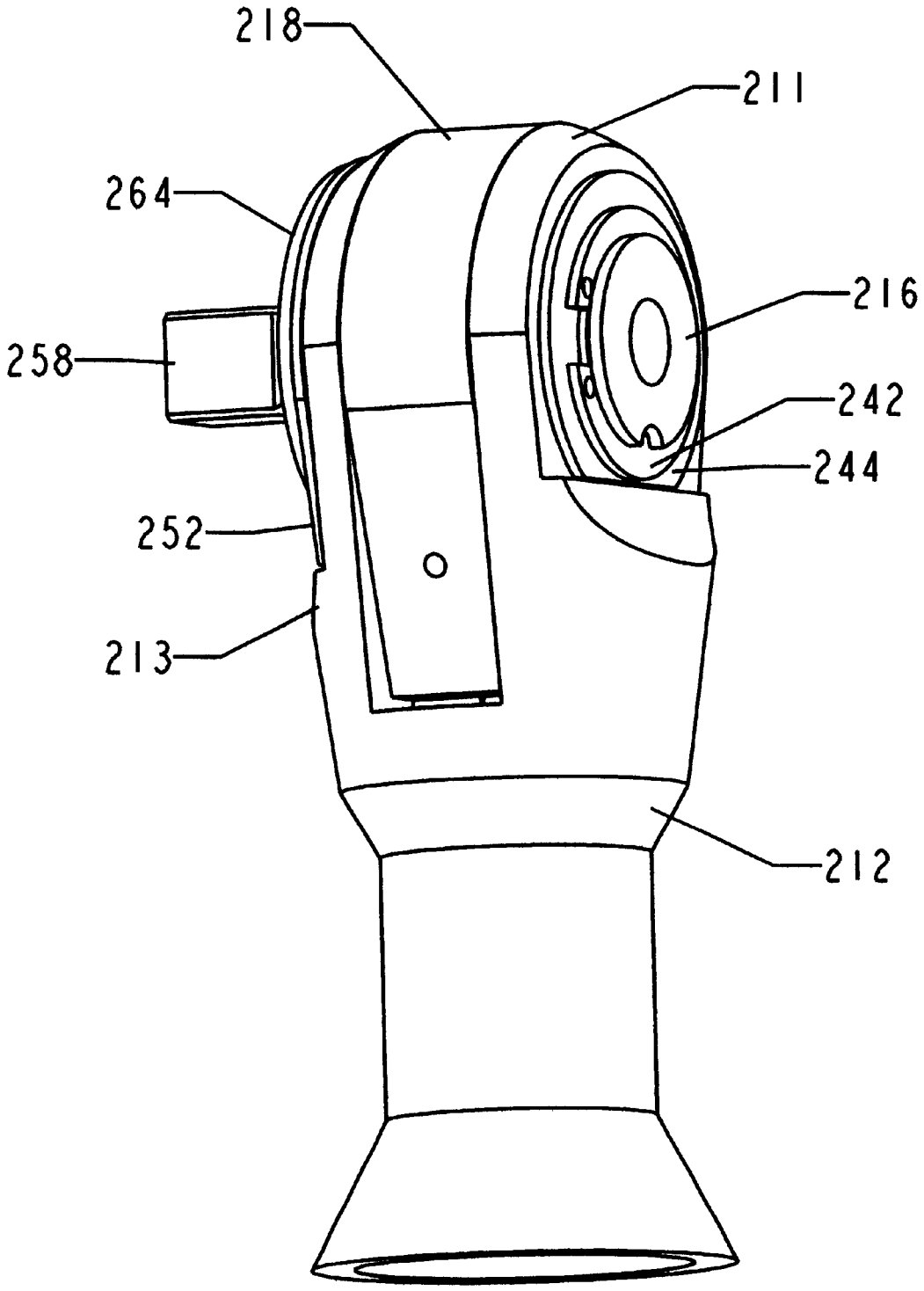
FIG. 8 is a rear perspective view of an assembled second preferred embodiment of the present invention.
Figure 9:
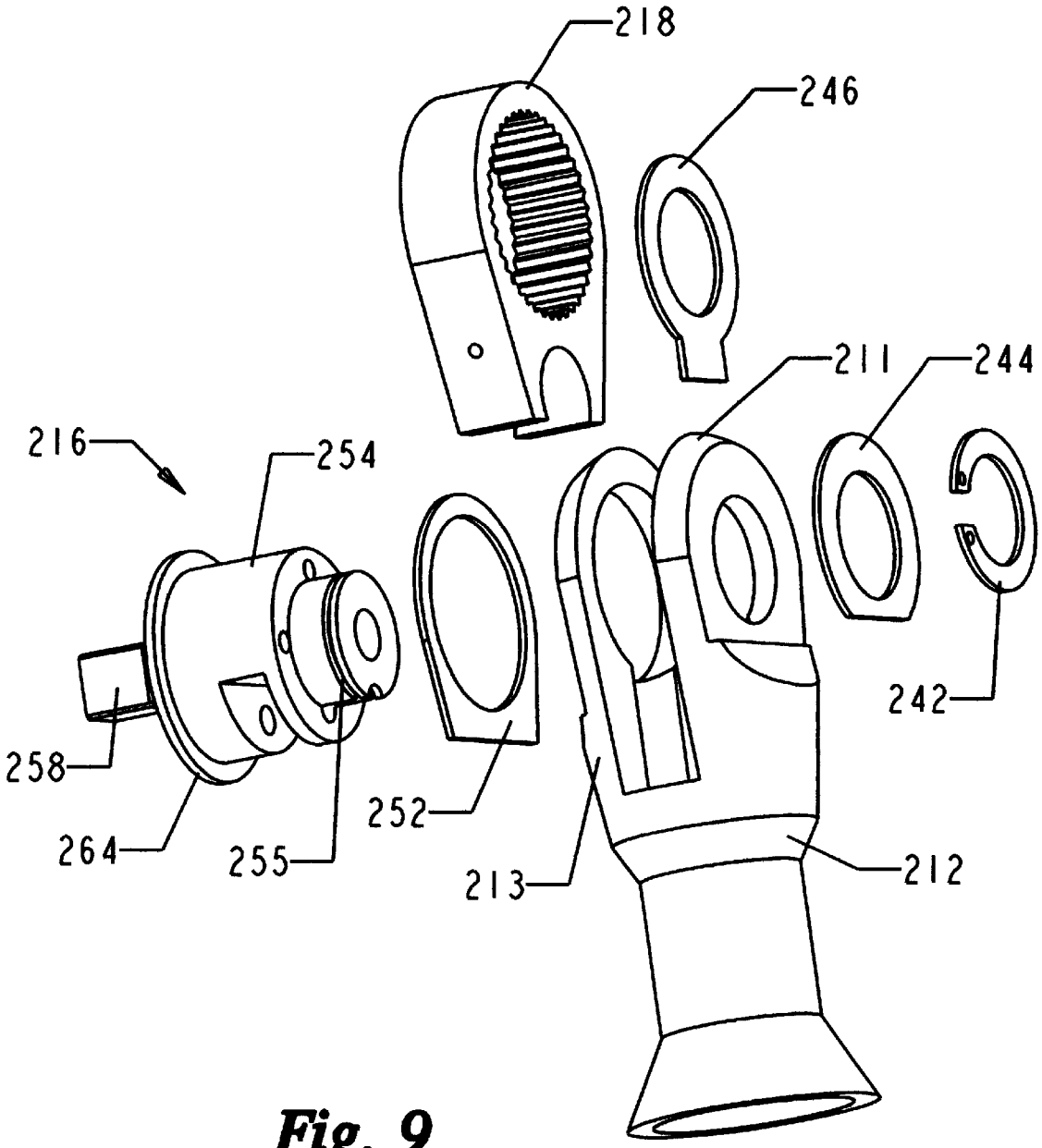
FIG. 9 is an exploded perspective view of a second preferred embodiment of the present invention.

Referring now to FIGS. 7, 8 and 9, there is shown a second preferred embodiment of the present invention. The second preferred embodiment, and the third preferred embodiment described below are similar to the first embodiment in having similar tensioning mechanisms, drive mechanisms, housings, handle portions, actuation button, and air inlet ports. As such, these similar aspects are not discussed in relation to the additional embodiments of the present invention.

Second preferred embodiment 200 includes a ratchet head 212 having ears 211 and 213. Within ears 211, 213 are formed bores for placement of a ratchet mechanism 216 as described below. Inserted between ears 211 and 213 is yoke 218. Yoke 218 has a bore formed within it having teeth formed about the circumference of the bore. Yoke 218 also has a drive bushing journal for engagement with drive bushing which imparts force on yoke 218 from the crank, as shown in FIG. 4, causing yoke 218 to swivel or reciprocate. Ratchet mechanism 216 comprises a ratchet body 254, at least one pawl (not shown), and drive square 258. A shift lever such as is shown in FIG. 4 designated as 140, is inserted within the bore formed within ratchet body 254. Ratchet body 254 has a groove 255 formed at the upper end of ratchet body 254 and a flange 264 which extends radially outwardly from the lower end of ratchet body 254 adjacent drive square 258.

When assembled ratchet mechanism 216 is inserted within the bores formed in ear 211, yoke 218 and ear 213. Wear washers 252, 246 and 244 are position about ratchet mechanism 216 along the areas of contact between ratchet mechanism 216, and ratchet head 212. Wear washers 252, 246 and 244 are replaceable and decrease wear on the ratchet head 212. Ratchet mechanism 216 is retained within ratchet head 212 by placing external snap ring 242 within groove 255 formed on ratchet mechanism 216.

Although the second embodiment of the present invention is shown and described having the radially extending flange 264 on the lower portion of ratchet mechanism 216, flange 264 may be formed on the upper portion of ratchet mechanism 216 by inverting the position of drive square 258 and flange 264 to the upper end of ratchet body 254. In turn, groove 255 would be formed on the lower portion of ratchet mechanism 216 for acceptance of snap ring 242. Reversing the positions of flange 264 and groove 255 would still allow for externally capturing ratchet mechanism 216 within ratchet head 212.

As ratchet mechanism 216 is externally captured within ratchet head 212 on the upper end by snap ring 242, and the lower end by flange 264, the ears 211, 213 of ratchet head 212 cannot readily spread apart. As described in association with the first preferred embodiment, preventing ears 211, 213 from spreading inhibits malfunction of the ratchet action of wrench 200.

Figure 10:
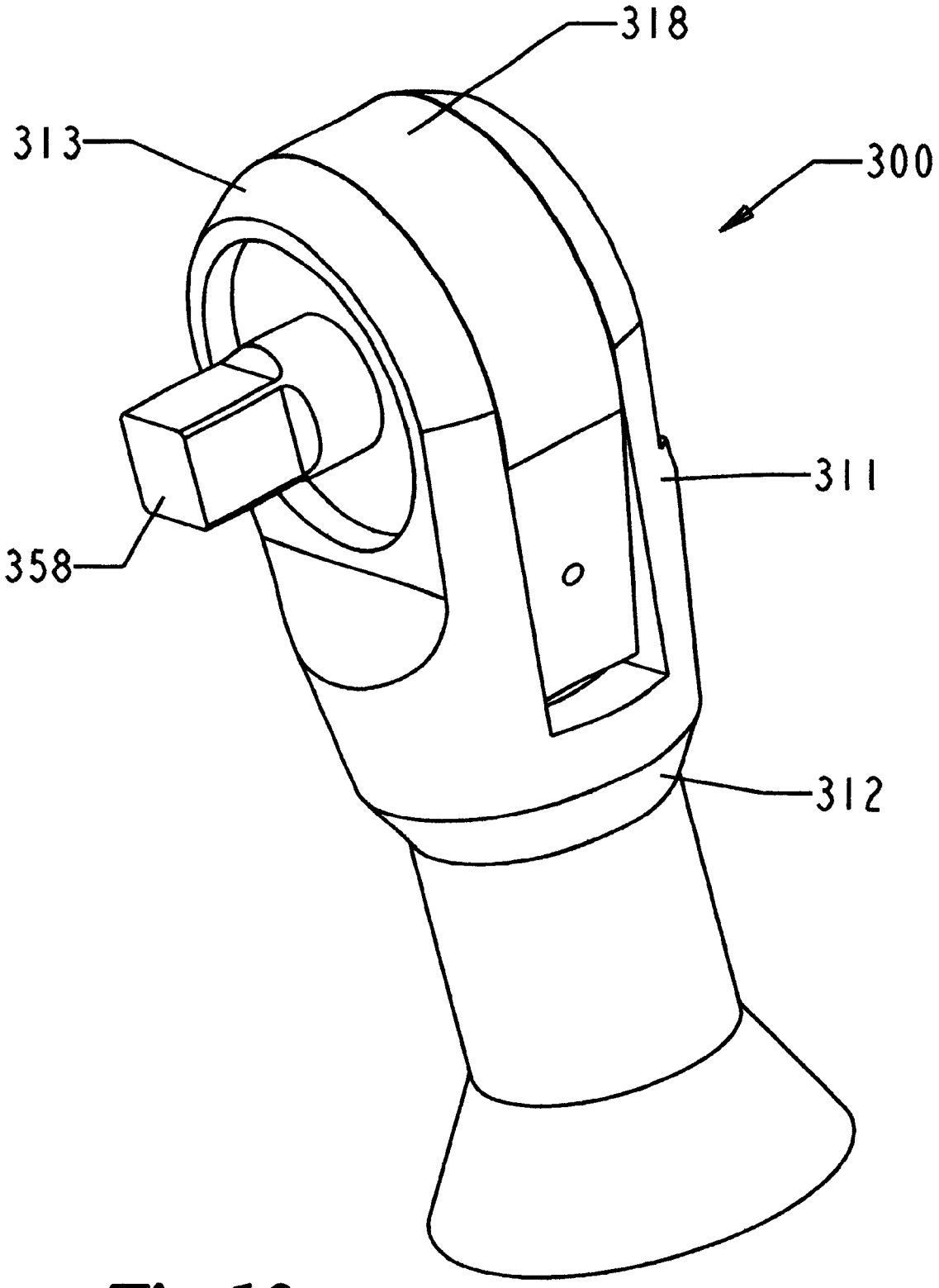
FIG. 10 is a front perspective view of an assembled third preferred embodiment of the present invention.
Figure 11:
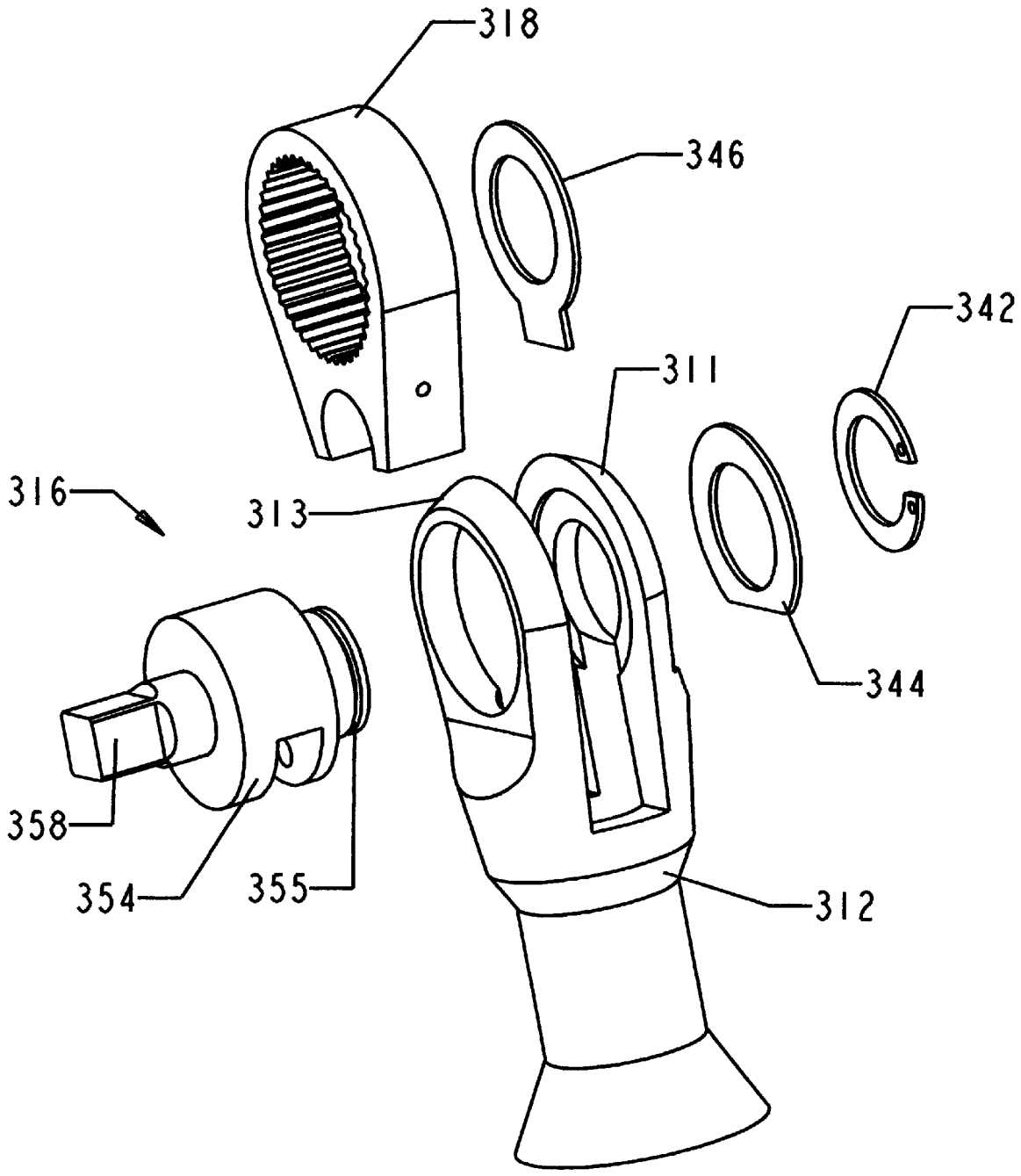
FIG. 11 is an exploded front perspective view of a third preferred embodiment of the present invention.
Figure 12:
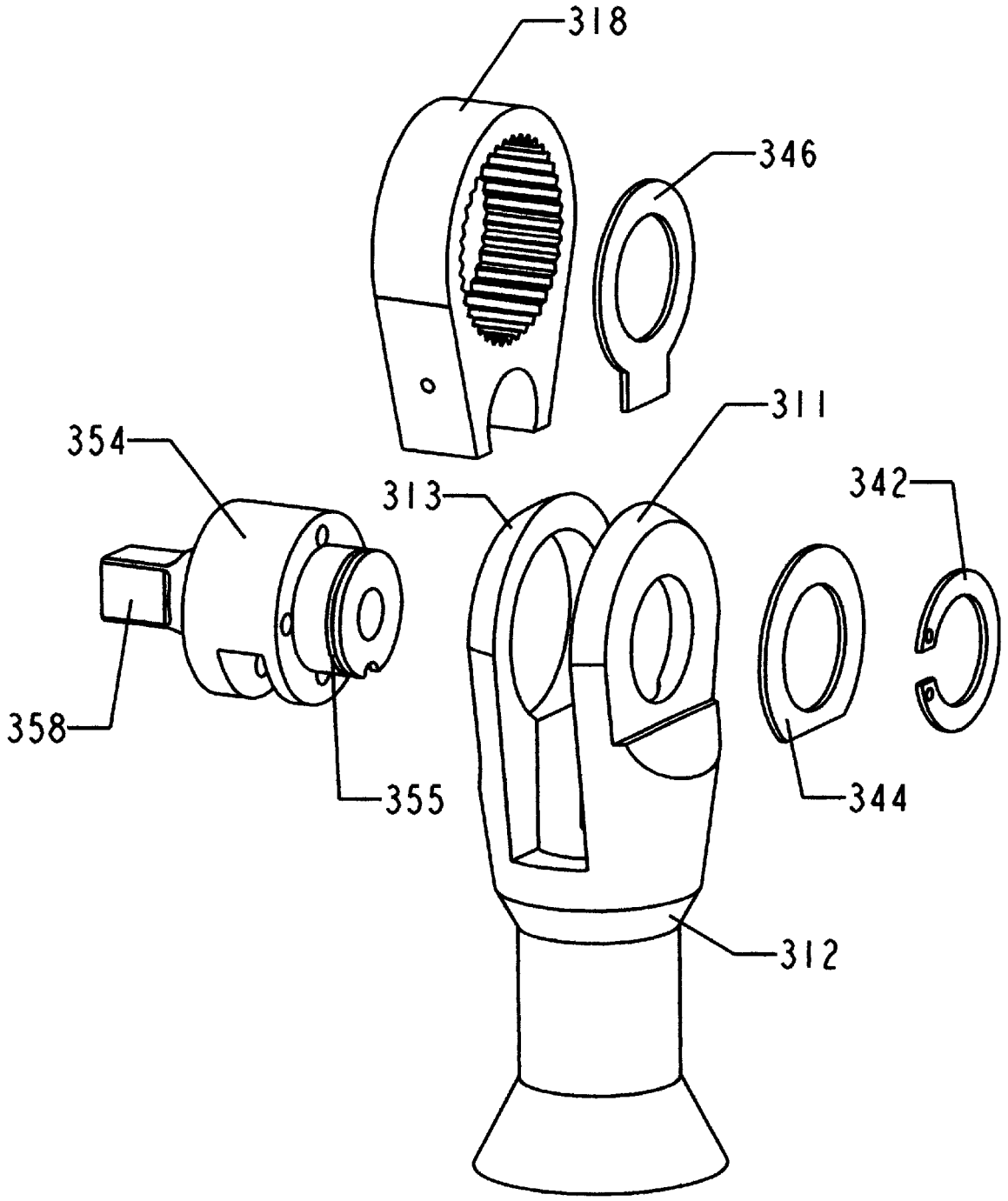
FIG. 12 is an exploded rear perspective view of a third preferred embodiment of the present invention.

Referring now to FIGS. 10 through 12, there is shown a third preferred embodiment of the present invention shown generally at 300. Ratchet design 300 includes a ratchet head portion 312 having ears 311 and 313. Ears 311 and 313 each have a bore formed therein for acceptance of a ratchet mechanism 316. Positioned between ears 311, 313 is yoke 318, which in turn has a bore formed therein having teeth formed about the circumference of said bore.

As illustrated in FIGS. 11 and 12, ratchet design 300 also includes a ratchet mechanism 316. Ratchet mechanism 316 includes a ratchet body 354, a slot for accepting at least one pawl (not shown), and a drive square 358. Like the first and second preferred embodiments of the present invention, a shift lever is placed within a bore formed within ratchet body 354 for selecting the direction of rotation of drive square 358. A groove 355 is formed on the upper portion of ratchet body 354.

In assembling ratchet design 300, ratchet mechanism 316 is placed through ear 313 and within the bore formed in ear 311 and the bore formed within yoke 318. The lower portion of ratchet body 354 is positioned adjacent to the bore formed in ear 313. Wear washer 346 is placed about ratchet mechanism 316 along the inner surface of ear 311, while wear washer 344 is placed around ratchet mechanism 316 along the outer surface of ear 311. Snap ring 342 is placed within groove 355 to retain ratchet mechanism 316 within the ratchet head portion 312 and complete the assembly. Because ratchet mechanism 316 is externally retained by snap ring 342, loss of head tension is deterred because, as discussed in previous embodiments, the tensioning mechanisms are captured between the ratchet body 354 and wear washer 346 and held there by external snap ring 342. Spreading of ears 311 and 313, while not prevented as in other embodiments, does not effect head tension, and in turn functioning of the ratchet wrench 300. Further, as with the previous embodiments, use of replaceable wear washers 344 and 346 along the wear surfaces decreases wear and damage to ratchet head portion 312 itself, increasing the life of the tool and decreasing tool maintenance costs.

As shown in FIGS. 3 through 12, yoke 118, 218 and 318 of the three preferred embodiments of the present invention may be provided with a lubrication port for application of lubricants, such as grease for example, to the area of engagement between the teeth formed on the inner surface of yoke 118, 218 or 318, and the teeth formed on the ends of the pawl(s) of the ratchet mechanism. Further, lubrication port may be provided with more than one outlet, with one of these outlets allowing for the application of lubricants to the drive mechanism, i.e. the ball and crank, of the powered ratchet wrench.

Although the principles, preferred embodiments and preferred operation of the present invention have been described in detail herein, this is not to be construed as being limited to the particular illustrative forms disclosed. They will thus become apparent to those skilled in the art that various modifications of the preferred embodiments herein can be made without departing from the spirit or scope of the invention as defined by the appended claims.

What is claimed:

1. A ratchet wrench comprising:

a handle;

a head, said head having a first ear, a second ear, and a bore formed through the ears for receiving a ratchet mechanism;

a yoke positioned between the ears, said yoke having a bore formed therein and teeth formed about the circumference of the bore;

said ratchet mechanism having an upper surface, a midline and a lower surface, a drive square extending from the lower surface, and at least one pawl associated with said ratchet mechanism and having teeth formed on the ends thereof;

means for retaining said ratchet mechanism within said head, said retaining means comprising a first mechanical fastener engaging said ratchet mechanism external to said first ear, and a second mechanical fastener engaging said ratchet mechanism external to said second ear; and, means for tensioning the ratchet mechanism against the retaining means.

2. A ratchet wrench comprising:

a handle portion;

a head portion, said head portion having a first ear, a second ear, and a bore formed through said ears for receiving a ratchet mechanism;

a yoke positioned between said ears, said yoke having a bore formed therein and teeth formed along the circumference of said bore;

said ratchet mechanism having an upper surface, a midline and a lower surface, a drive square extending perpendicularly from said lower surface, and at least one pawl associated with said ratchet mechanism, and having teeth formed at the ends of said pawl;

a first mechanical fastener engaging said ratchet mechanism external to said first ear;

a second mechanical fastener engaging said ratchet mechanism external to said second ear;

said first and second mechanical fasteners retaining said ratchet mechanism within said head portion.

3. A ratchet wrench as recited in claim 2, further comprising:

a wear washer positioned between said first mechanical fastener and an outer surface of said first ear.

4. A ratchet wrench as recited in claim 2, further comprising:

a wear washer positioned about said ratchet mechanism, adjacent an inner surface of said first ear.

5. A ratchet wrench as recited in claim 2, further comprising:

a wear washer positioned between said second mechanical fastener and an outer surface of said second ear.

6. A ratchet wrench as recited in claim 2, wherein said ratchet mechanism further comprises a groove formed upward of said midline, and a groove formed below said midline.

7. A ratchet wrench as recited in claim 6, wherein said first and second mechanical fasteners comprise snap rings engaged within said upper groove and said lower groove.

8. A ratchet wrench as recited in claim 2, further comprising at least one means for tensioning.

9. A ratchet wrench as recited in claim 8, wherein said at least one tensioning means is a belleville spring washer.

10. A ratchet wrench as recited in claim 8, wherein said at least one tensioning means is comprised of a coil spring.

11. A ratchet wrench as recited in claim 10, wherein said at one tensioning means further comprises a friction device associated with said coil spring.

12. A ratchet wrench as recited in claim 11, wherein said friction device is a ball.

13. A ratchet wrench as recited in claim 11, wherein said friction device is a cylindrical plunger.

14. A ratchet wrench as recited in claim 1, wherein said first and second mechanical fasteners are snap rings engaging said ratchet mechanism externally to each of said ears of said head.

15. A ratchet wrench comprising:

a handle portion;

a head portion, said head portion having a first ear, a second ear, and a bore formed through said ears for receiving a ratchet mechanism;

a yoke positioned between said ears, said yoke having a bore formed therein and teeth formed along the circumference of said bore;

said ratchet mechanism having an upper surface, a midline and a lower surface, a drive square extending perpendicularly from one of said surfaces, a flange extending radially outwardly from said lower surface, a groove formed upward of said midline, and at least one pawl having teeth formed at the ends thereof;

a snap ring engaged within said groove;

said snap ring retaining said ratchet mechanism within said head portion;

a first wear washer positioned between said snap ring and an outer surface of said first ear;

a second wear washer positioned about said ratchet mechanism, adjacent an inner surface of said first ear; and, a third wear washer positioned between said radially extending flange and an outer surface of said second ear.

16. A ratchet wrench as recited in claim 15, further comprising at least one means for tensioning.

17. A ratchet wrench as recited in claim 16, wherein said at least one tensioning means is a belleville washer.

18. A ratchet wrench as recited in claim 16, wherein said at least one tensioning means is comprised of a coil spring.

19. A ratchet wrench as recited in claim 18, wherein said at least one tensioning means further comprises a friction device associated with said coil spring.

20. A ratchet wrench as recited in claim 19, wherein said friction device is a ball.

21. A ratchet wrench as recited in claim 19, wherein said friction device is a cylindrical plunger.

22. A ratchet wrench comprising:

a handle portion;

a head portion, said head portion having a first ear and a second ear, and a bore formed through said ears for receiving a ratchet mechanism;

a yoke positioned between said pair of ears, said yoke having a bore formed therein and teeth formed along the circumference of said bore;

said ratchet mechanism having an upper surface and a lower surface, a drive square extending from said lower surface, and at least one pawl having teeth formed at the ends thereof;

a mechanical fastener engaging said ratchet mechanism adjacent and externally to one of said ears of said head portion;

at least one wear adjacent to said head; and;

said mechanical fastener retaining said ratchet mechanism within said head portion.

23. A ratchet wrench as recited in claim 22, further comprising:

a wear washer positioned between said mechanical fastener and an outer surface of one of said pair of ears.

24. A ratchet wrench as recited in claim 22, further comprising a wear washer positioned about said ratchet mechanism, adjacent an inner surface of one of said pair of ears.

25. A ratchet wrench as recited in claim 22, wherein said ratchet mechanism further comprises a groove formed adjacent said upper surface.

26. A ratchet wrench as recited in claim 25, wherein said mechanical fastener is comprised of a snap ring engaged within said upper surface groove.

27. A ratchet wrench as recited in claim 22, further comprising at least one means for tensioning.

28. A ratchet wrench as recited in claim 27, wherein said at least one tensioning means is a belleville spring washer.

29. A ratchet wrench as recited in claim 27, wherein said at least one tensioning means is comprised of a coil spring.

30. A ratchet wrench as recited in claim 29, wherein said at least one tensioning means further comprises a friction device associated with said coil spring.

31. A ratchet wrench as recited in claim 30, wherein said friction device is comprised of a ball.

32. A ratchet wrench as recited in claim 30, wherein said friction device is comprised of a cylindrical plunger.

33. A ratchet wrench comprising:

a handle;

a head, said head having a first ear, a second ear, and a bore formed through the ears for receiving a ratchet mechanism;

a yoke positioned between the ears, said yoke having a bore formed therein and teeth formed about the circumference of the bore;

said ratchet mechanism having an upper surface, a midline and a lower surface, a drive square extending perpendicularly from the lower surface;

means for retaining said ratchet mechanism within said head, said means comprising a first and second snap ring adapted for engagement with said ratchet mechanism, external to said first and second ear;

wherein said first and second snap ring prevent said first and second ears from spreading outwardly;

means for biasing the ratchet mechanism against the means for retaining; and, at least one replaceable wear washer associated with said ratchet mechanism.

34. A ratchet wrench comprising:

a handle portion;

a head portion, said head portion having a first ear, a second ear, and a bore formed through said ears for receiving a ratchet mechanism;

a yoke positioned between said ears, said yoke having a bore formed therein and teeth formed along the circumference of said bore;

said ratchet mechanism having an upper surface, a midline and a lower surface, a drive square extending perpendicularly from said lower surface, and at least one pawl associated with said ratchet mechanism, and having teeth formed at the ends of said pawl;

means for retaining said ratchet mechanism within said head, said means being external to said head;

at least one wear washer adjacent to said head, said wear washer adapted not to rotate in conjunction with the rotation of said ratchet mechanism.

35. A ratchet wrench as recited in claim 34, wherein said at least one wear washer is positioned adjacent to the outer surface of at least one of said ears of said head.

36. A ratchet wrench as recited in claim 34, wherein said at least one wear washer is positioned adjacent to the inner surface of at least one of said ears of said head.

37. A ratchet wrench as recited in claim 34, further comprising:

a wear washer positioned adjacent the outer surface of each of said ears of said head; and, at least one wear washer adjacent to the inner surface of at least one of said ears of said head.

38. A ratchet wrench as recited in claim 34, wherein said at least one wear washer is replaceable.

39. A ratchet wrench as recited in claim 34, wherein said at least one wear washer is constructed in a manner to engage said ratchet head to prevent movement of said at least one wear washer.

40. A ratchet wrench as recited in claim 34, wherein said at least one wear washer remains stationary during rotation of said ratchet mechanism.

* * * * *

UNITED STATES PATENT AND TRADEMARK OFFICE

CERTIFICATE OF CORRECTION

PATENT NO. : 6,490,953 B2
DATED : December 10, 2002
INVENTOR(S) : John Horvath

It is certified that error appears in the above-identified patent and that said Letters Patent is hereby corrected as shown below:

Column 8,
Line 1, replace "at least one wear adjacent to said head; and;" with
-- at least one wear washer adjacent to said head; and; -- .

Signed and Sealed this

Eleventh Day of March, 2003

JAMES E. ROGAN
*Director of the United States Patent and Trademark Office*